US008733875B2

(12) United States Patent
Oshige

(10) Patent No.: US 8,733,875 B2
(45) Date of Patent: May 27, 2014

(54) LIQUID DISCHARGE APPARATUS AND LIQUID DISCHARGE METHOD

(75) Inventor: Hiroshi Oshige, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 107 days.

(21) Appl. No.: 13/301,861

(22) Filed: Nov. 22, 2011

(65) Prior Publication Data

US 2012/0133694 A1 May 31, 2012

(30) Foreign Application Priority Data

Nov. 25, 2010 (JP) ..... 2010-262188
Nov. 9, 2011 (JP) ..... 2011-245215

(51) Int. Cl.
*B41J 29/38* (2006.01)

(52) U.S. Cl.
USPC ..... 347/14

(58) Field of Classification Search
USPC ..... 347/5–20, 40–43, 101, 104, 107
IPC ..... B41J 29/38
See application file for complete search history.

(56) References Cited

U.S. PATENT DOCUMENTS

| | | | | |
|---|---|---|---|---|
| 2004/0196329 | A1* | 10/2004 | Ready et al. | 347/40 |
| 2008/0136856 | A1* | 6/2008 | Azami et al. | 347/16 |
| 2009/0009551 | A1* | 1/2009 | Takahashi | 347/14 |
| 2009/0085959 | A1* | 4/2009 | Yoshida et al. | 347/20 |
| 2009/0115805 | A1* | 5/2009 | Yoshida et al. | 347/9 |
| 2009/0179935 | A1* | 7/2009 | Otokita | 347/15 |
| 2010/0245440 | A1* | 9/2010 | Usuda et al. | 347/14 |
| 2010/0253728 | A1* | 10/2010 | Yoshida et al. | 347/14 |

FOREIGN PATENT DOCUMENTS

JP 2007-144946 A 6/2007

* cited by examiner

*Primary Examiner* — Manish S Shah
*Assistant Examiner* — Roger W Pisha, II
(74) *Attorney, Agent, or Firm* — Maschoff Brennan

(57) ABSTRACT

A liquid discharge apparatus includes: movable head having a nozzle line with nozzles arranged in a predetermined direction; and a control unit that performs a first liquid discharge process and a second liquid discharge process, which sequentially form dots on a medium by intermittently discharging liquid from the nozzles while moving the head and maintaining the inclusion of a normal component perpendicular to the predetermined direction in the moving direction of the head and which form dots on the medium such that a dot formation position in the perpendicular direction of the dots formed in the second liquid discharge process is positioned between dot formation positions in the perpendicular direction of the dots formed continuously in the first liquid discharge process.

4 Claims, 13 Drawing Sheets

LIQUID DISCHARGE APPARATUS AND LIQUID DISCHARGE METHOD

BACKGROUND

This application claims priority to Japanese Patent Application Nos. 2010-262188, filed Nov. 25, 2010 and 2011-245215, filed Nov. 9, 2011, the entirety of which is incorporated herein by reference.

1. Technical Field

The present invention relates to a liquid discharging apparatus and a liquid discharging method.

2. Related Art

There is known a liquid discharge apparatus that records images or the like by discharging liquid from a nozzle such that droplets (dots) are landed onto a medium. When performing recording using this kind of liquid discharge apparatus, it is not always possible to discharge dots to the desired discharge positions due to errors in the nozzle accuracy of the nozzle which are caused in the manufacturing stage. As a result, density irregularity (for example, white stripes or black stripes) is generated in the recorded image and the image quality of the recorded image is deteriorated.

There is a method of making discharge errors unrecognizable and reducing the visibility of density irregularity by forming one dot line by several-time discharge operations, using different nozzles. For example, there has been a method of suppressing deterioration of an image quality by averaging the deviation of landing positions of dots, by respectively changing the nozzles that discharge liquid in a liquid discharge operation on a going-path and a liquid discharge operation on a returning-path, in a liquid discharge apparatus that forms dot lines in the reciprocation direction by discharging the liquid while reciprocating the nozzles.

There is a method of adjusting the timing of discharging liquid, as a method of suppressing density irregularity or disarray in an image due to a conveying error of a recording target medium. For example, a method of forming inclined dot lines and suppressing deterioration of an image, when a medium is conveyed at an angle by skew, by shifting the nozzles discharging the liquid in accordance with the inclination is suggested (For example, JP-A-2007-144946).

According to the method described above, it is possible to reduce the visibility of the influence of density irregularity, even though density irregularity is generated when an image is recorded by a liquid discharge apparatus. However, when an error in accuracy of the nozzle is large, for example, when the gap between the n-th nozzle and the n+1-th nozzle is remarkably large in comparison to the gaps between other nozzles in the nozzle lines, it is difficult to reduce the visibility of the influence of the density irregularity in the method. This is because the striped density irregularity is visible at the portion with the large gap between the nozzles, even if the nozzles used in the going-path and the returning-path are changed. As described above, it is difficult to sufficiently reduce the visibility of the density irregularity invisible in the method of the related art.

SUMMARY

An advantage of some aspects of the invention is to reduce the visibility of density irregularity, when recording an image by using a liquid discharge apparatus.

According to an aspect of the invention, there is provided a liquid discharge apparatus that includes: a nozzle line with nozzles arranged in a predetermined direction; a movable head; and a control unit that performs a first liquid discharge process and a second liquid discharge process, which sequentially form dots on a medium by intermittently discharging liquid from the nozzles while moving the head and maintaining the inclusion of a normal component perpendicular to the predetermined direction in the moving direction of the head and which form dots on the medium such that a dot formation position in the perpendicular direction of the dots formed in the second liquid discharge process is positioned between dot formation positions in the perpendicular direction of the dots continuously formed in the first liquid discharge process, in which the control unit moves the head such that the component of the predetermined direction is included in the moving direction of any one of the first liquid discharge process and the second liquid discharge process while the moving directions cross each other, at least at a position of a portion in the perpendicular direction.

Other features of the invention will be made clear from the specification and the description of the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
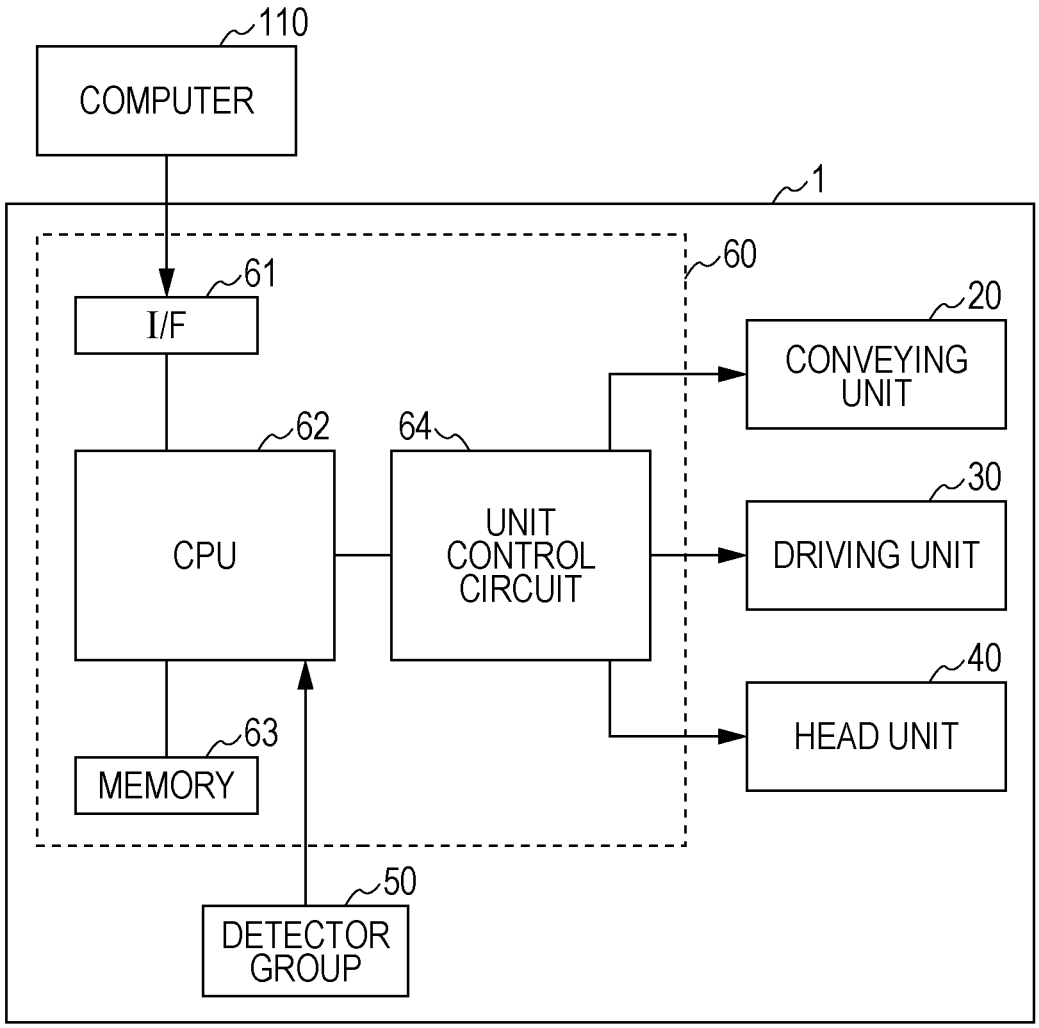
FIG. 1 is a block diagram showing the configuration of a printer.

At least the followings are made clear by the description of the specification and the accompanying drawings.

A liquid discharge apparatus includes: a movable head having a nozzle line with nozzles arranged in a predetermined direction; and a control unit that performs a first liquid discharge process and a second liquid discharge process, which sequentially form dots on a medium by intermittently discharging liquid from the nozzles while moving the head and maintaining the inclusion of a normal component perpendicular to the predetermined direction in the moving direction of the head and which form dots on the medium such that a dot formation position in the perpendicular direction of the dots formed in the second liquid discharge process is positioned between dot formation positions in the perpendicular direction of the dots continuously formed in the first liquid discharge process, in which the control unit moves the head such that the component of the predetermined direction is included in the moving direction of any one of the first liquid discharge process and the second liquid discharge process while the moving directions cross each other, at least at a position of a portion in the perpendicular direction.

According to the liquid discharge apparatus, it is possible to reduce the visibility of density irregularity because the density irregularity is shown not in a stripe shape but in a dot shape even if the density irregularity is generated when an image is recorded.

It is preferable that the control unit move the head such that the components of the moving perpendicular directions of the moving directions of both the first liquid discharge process and the second liquid discharge process are opposite to each other, in the liquid discharge apparatus.

According to the liquid discharge apparatus, since it is possible to print an image by moving the head in both directions, it is possible to increase the print speed, as compared with when an image is printed by moving the head in the end direction.

In the liquid discharge apparatus, it is preferable that the control unit moves the head such that the moving direction in the first liquid discharge process and the moving direction in the second liquid discharge process are symmetric with respect to the perpendicular direction or the predetermined direction.

According to the liquid discharge apparatus, since the moving direction of the head and the liquid discharge position in the first liquid discharge process and the moving direction of the head and the liquid discharge position in the second liquid discharge process are symmetric, respectively, in the predetermined direction or the perpendicular direction, it is simple to control the operation of the head and create liquid discharge data, such that load exerted in a controller becomes small.

In the liquid discharge apparatus, a first mode that is suitable for forming a line image that is an image mainly implemented by lines and a second mode that is suitable for forming a natural image that is an image of a photograph are selectable and, when the second mode is selected, as an image forming mode when an image is formed by the head, it is preferable that the control unit move the head such that the component of the predetermined direction is included in the moving direction at least in any one of the first liquid discharge process and the second liquid discharge process while both moving directions cross each other, at least at a position of a portion in the perpendicular direction.

According to the liquid discharge apparatus, it is possible to reduce the visibility of density irregularity invisible by changing the image recording method in accordance with the characteristics of an image that is formed.

Further, a liquid discharge method includes: moving a head having a nozzle line with nozzles arranged in a predetermined direction; and performing a first liquid discharge process and a second liquid discharge process, using a control unit, which sequentially form dots on a medium by intermittently discharging liquid from the nozzles while moving the head and maintaining the inclusion of a normal component perpendicular to the predetermined direction in the moving direction of the head and which form dots on the medium such that a dot formation position in the perpendicular direction of the dots formed in the second liquid discharge process is positioned between dot formation positions in the perpendicular direction of the dots continuously formed in the first liquid discharge process, in which the control unit moves the head such that the component of the predetermined direction is included in the moving direction of any one of the first liquid discharge process and the second liquid discharge process while the moving directions cross each other, at least at a position of a portion in the perpendicular direction.

Basic Configuration of Liquid Discharge Apparatus

An ink jet printer (printer 1) is exemplified as an embodiment of a liquid discharge apparatus for implementing the invention.

Configuration of Printer 1

FIG. 1 is a block diagram showing the entire configuration of a printer 1.

The printer 1 is a liquid ejecting apparatus that records (prints) characters or images by discharging ink onto a medium, such as paper, cloth, or film and is connected with a computer 110 that is an external device to be able to communicate.

A printer driver is installed in the computer 110. The printer driver is a program for displaying a user interface on the display device and converting image data output from an application program into print data. The printer driver is recorded on a recording medium (a computer-readable recording medium), such as a flexible disk FD or a CD-ROM. Further, the printer driver can also be downloaded to the computer 110 through the Internet. Further, the program is composed of codes for implementing various functions.

The computer 110 outputs print data to the printer in accordance with an image to print, in order to print the image in the printer 1.

Figure 2A:
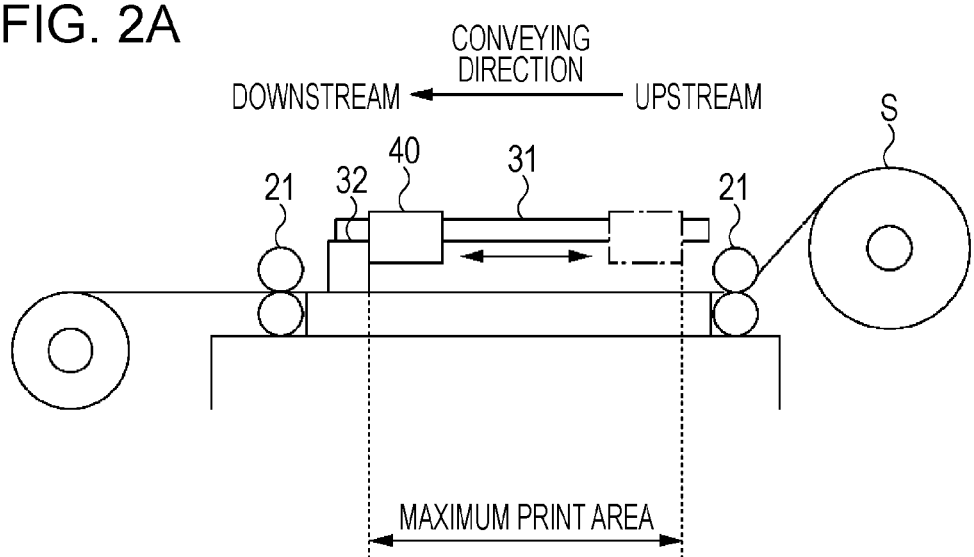
FIG. 2A is a schematic cross-sectional view illustrating the configuration of the printer of the embodiment.
Figure 2B:
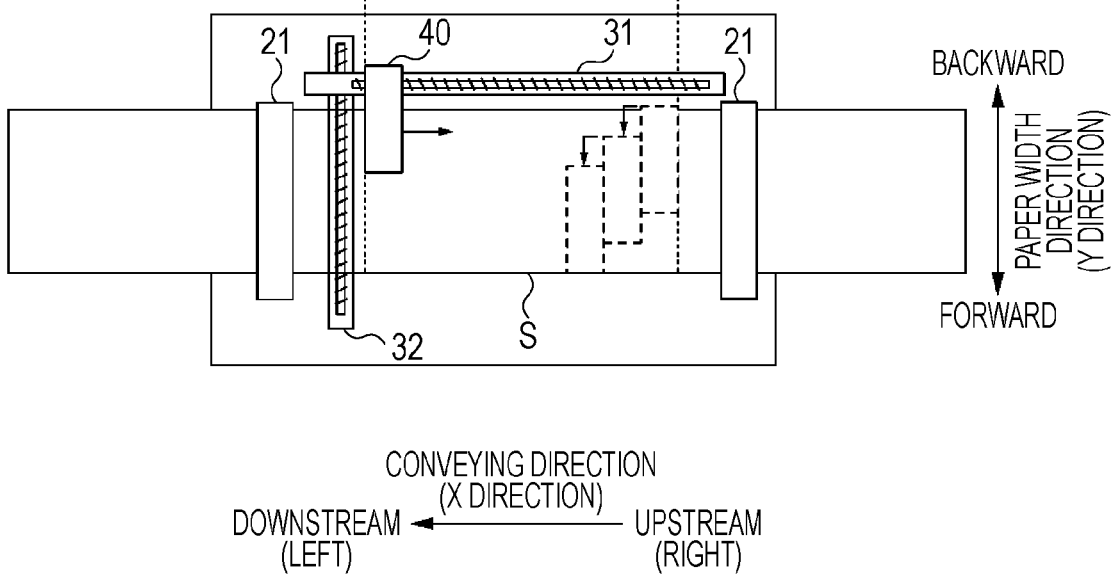
FIG. 2B is a schematic top view illustrating the configuration of the printer of the embodiment.

FIG. 2A is a schematic cross-sectional view of the printer 1 and FIG. 2B is a schematic top view of the printer 1. The printer 1 includes a conveying unit 20, a carriage unit 30, a head unit 40, a detector group 50, and a controller 60. The controller 60 controls the units on the basis of print data received from the computer 110, which is an external device, to print an image on a medium. The situation in the printer is monitored by the detector group 50 and the detector group 50 outputs the detection result to the controller 60. The controller 60 controls the units on the basis of the detection result output from the detector group 50.

Conveying Unit 20

The conveying unit 20 is provided to convey a medium S (for example, paper or the like) from the upstream side to the downstream side in a conveying direction (or X-direction). The medium S is supplied to a print area in a roll shape before printing by conveying rollers 21 driven by a conveying motor (not shown), and then, the medium S that has undergone printing is wound in a roll shape by a winding mechanism, or is cut in an appropriate length and discharged. The operation of the conveying motor is controlled by the controller 60 at a side in the printer. Further, the medium S is vacuum-sucked downward and held at a predetermined position.

Driving Unit 30

The driving unit 30 is provided to freely move the head unit 40 in the X direction corresponding to the conveying direction and the Y direction corresponding to the paper width direction (direction perpendicular to the conveying direction) of the medium S. The driving unit 30 is composed of an X-axial stage 31 that moves the head unit 40 in the X-direction, a Y-axial stage 32 that moves the X-axial stage 31 in the Y-direction, and a motor (not shown) that moves the stages.

Head Unit 40

The head unit 40 is provided to form an image by discharging the ink onto the paper S and includes a plurality of heads 41. A plurality of nozzles, which are ink ejecting parts, is disposed on the bottom of the head 41 and an ink chamber filled with ink is provided in each of the nozzles.

The head unit 40 is disposed at the X-axial stage 31, and when the X-axial stage 31 moves in the X direction (conveying direction), the head unit 40 correspondingly moves in the X-direction. Further, when the Y-axial stage moves in the Y direction (paper width direction), the head unit 40 correspondingly moves in the Y-direction. Further, it is possible to move the head unit 40 in a direction inclined with respect to the X direction by moving the head unit 40 in the X direction simultaneously with in the Y-direction. A dot line (raster line) is formed in the inclined direction on the medium S by intermittently discharging the ink from the nozzles while the head unit 40 moves. Thereafter, the head unit 40 is moved in the Y direction (paper width direction) across the X-axial stage by the Y-axial stage 32 and is moved again in the inclined direction, thereby performing printing.

As described above, it is possible to print an image on the medium S in the print area by repeating the operation of forming a raster line by the movement of the head unit 40 and the movement of the head unit 40 in the Y-direction. A plurality of images is printed on continuous mediums S by alternately repeating the operation (image formation operation) of printing an image on the medium S supplied in the print area and the operation (conveying operation) of conveying the medium S in the conveying direction and supplying a portion of a new medium S into the print area by using the conveying unit 20.

Figure 3:
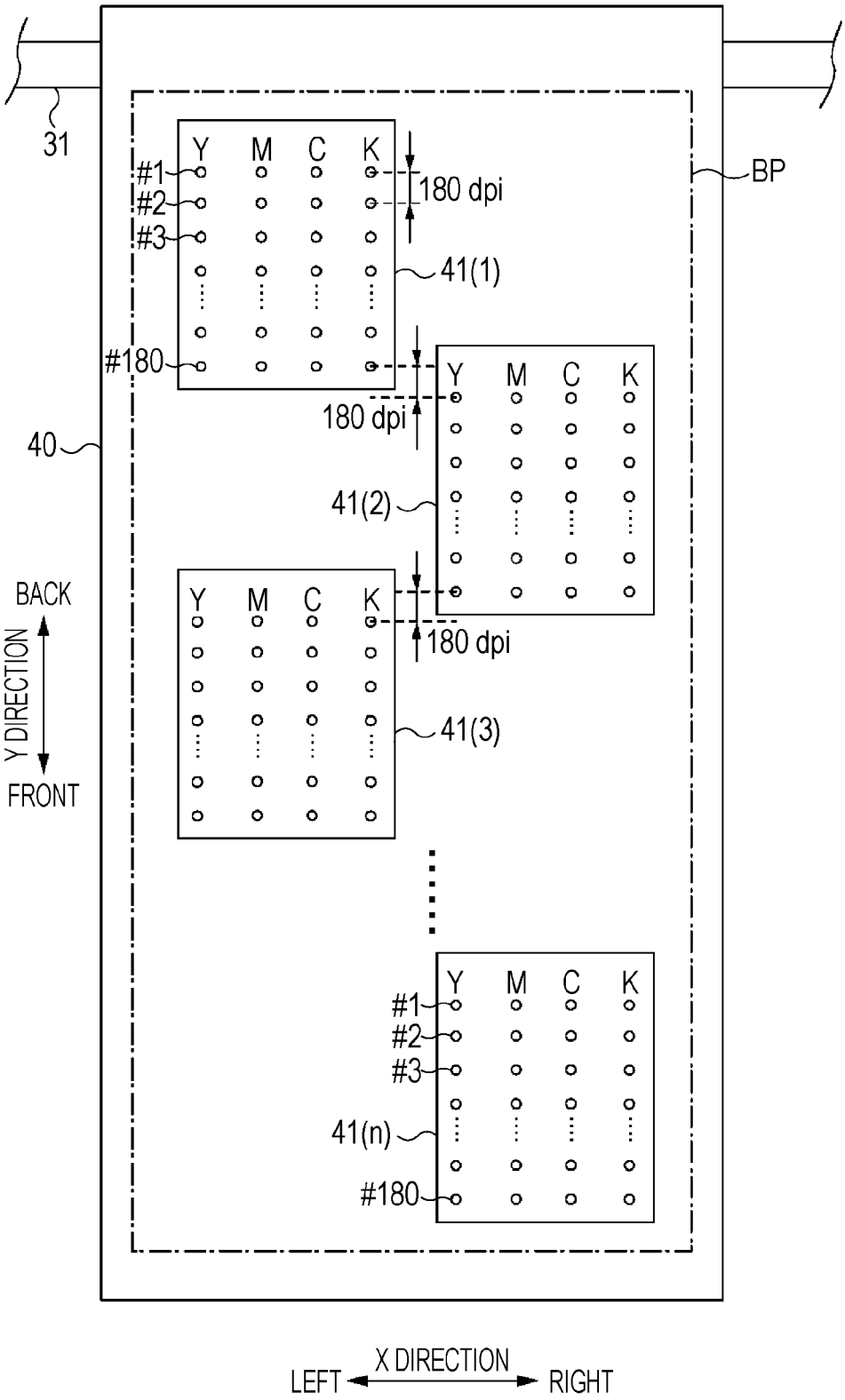
FIG. 3 is a view showing the arrangement of heads in a head unit.

FIG. 3 is a view showing the arrangement of the plurality of heads 41 in the head unit 40. Further, although the nozzle surfaces are actually formed on the bottom of the head unit 40, FIG. 3 is a view showing the nozzles virtually seen from the surface (the latter figures are the same).

Since a plurality of nozzles is arranged in the Y direction (paper width direction), it is possible to print an image having a large width by moving the head unit 40 once in the X direction (conveying direction). Accordingly, it is possible to increase the print speed. However, it is difficult to form a long head for a problem in manufacturing. A plurality of short heads 41(1) to 41(*n*) is arranged in the Y direction in the printer 1. As shown in FIG. 3, the plurality of heads 41 are mounted on a base plate BP.

A black nozzle line K ejecting black ink, a cyan nozzle line C ejecting cyan ink, a magenta nozzle line M ejecting magenta ink, and a yellow nozzle line Y ejecting yellow ink are formed on the nozzle surface of each head 41. One hundred eighty nozzles are provided in each nozzle line and aligned at a predetermined nozzle pitch (180 dpi) in the Y-direction. As shown in the figure, smaller numbers (#1 to #180) are sequentially given from the nozzle at the back in the Y-direction.

Further, the gap between the nozzle #180 at the most front side of the head 41(1) at the back in two nozzles adjacent in the Y direction (for example, 41(1) and 41(2)) and the nozzle #1 at the side which is the furthest back of the head 41(2) at the front is also the predetermined gap (180 dpi). That is, the nozzles are arranged at a predetermined nozzle pitch (180 dpi) in the Y-direction, on the bottom of the head unit 40. Further, as shown in FIG. 3, it is necessary to dispose the heads 41 in a zigzag in order to set the gap of the end nozzles of other heads 41 to 180 dpi, due to a structural problem of the head 41. Further, the end nozzles of other heads 41 may overlap.

Detector Group 50

The detector group 50 includes a rotary type encoder or a linear type encoder (neither are shown). The rotary type encoder detects the amount of rotation of the conveying rollers 21 and the conveying amount of the medium is detected on the basis of the detection result. The linear type encoder detects the position of the X-axial stage 31 or the Y-axial stage 32 in the movement direction.

Controller 60

The controller 60 is a control unit (control section) for controlling the printer. The controller 60 includes an interface unit 61, a CPU 62, a memory 63, and a unit control circuit 64 (FIG. 1).

The interface unit 61 communicates data between the computer 110 that is an external device and the printer 1. The CPU 62 is a calculation process unit for controlling the entire printer 1. The memory 63 is for ensuring an area where programs of the CPU 62 is received or an operation area and implemented by a storage device, such as RAM and EEPROM. Further, the CPU 62 controls the units, including the conveying unit 20, through the unit control circuit 64, in accordance with the programs received in the memory 63.

Comparative Example 1

A common printing operation of the related art using the printer 1 is described first as Comparative Example 1.

Description of Printing Operation

Figure 4:
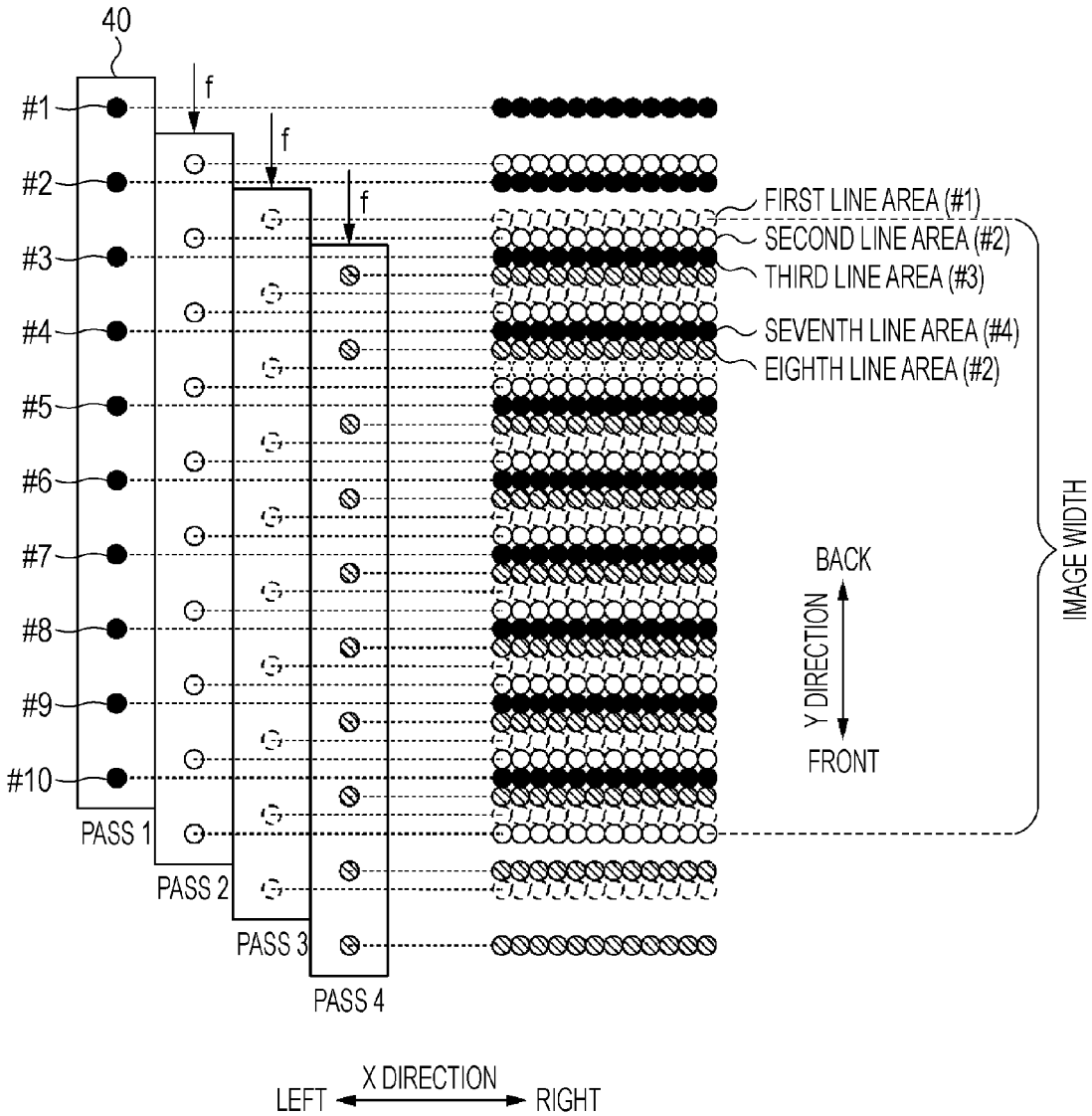
FIG. 4 is a view illustrating a printing operation performed by a printer according to Comparative Example 1.

FIG. 4 is a view illustrating a printing operation performed by the printer 1 according to Comparative Example 1. The number of nozzles arranged in the Y direction (paper width direction) in the head unit 40 is reduced to ten for simple description in the figure. One operation of forming an image by moving the head unit 40 in the X direction is referred to as a "pass". The printer 1 completes an image by four passes and forms a raster line of another pass between raster lines (dot lines in the X direction (conveying direction)) formed by certain passes. Therefore, it is possible to increase the print resolution in the Y direction to be larger than the nozzle pitch (180 dpi) and thus print a high-quality image.

In detail, first, ten raster lines (black circles) are formed by moving the head unit 40 in the X direction in the first pass. Thereafter, the head unit 40 is moved by a predetermined amount f to the front in the Y direction by the Y-axial stage 32. Further, ten raster lines (white circles) are formed by moving again the head unit 40 in the X direction in the second pass. In this process, the head unit is moved at a predetermined amount f in the Y direction such that the raster lines of the second pass are formed at the back in the conveying direction more than the raster lines formed in the first pass. As described above, an image is completed by repeating the operation of forming the raster lines by moving the head unit 40 in the X direction and the operation of moving the head unit 40 at a predetermined amount f in the Y-direction.

A time when the movement directions in the X direction of the head unit 40 in the first pass and the second pass are the same is referred to as unidirectional printing and a time when the movement directions in the X direction of the head unit 40 in the first pass and the second pass are different is referred to as bidirectional printing.

In the unidirectional printing, for example, the head unit 40 discharges ink while moving from the left to the right in the X-direction, thereby forming the raster lines, in the first pass. Thereafter, the head unit 40 moves by f in the Y direction after returning (returning operation) to the initial position from the right to the left in the X-direction, such that the printing operation of the second pass is performed in the same way as the first pass. In the unidirectional printing, since the ink is discharged in the same direction (X-direction), deviation of landing positions of the ink dots is small in the X-direction, which is suitable for printing an image with a good image quality or the like.

On the other hand, in the bidirectional printing, for example, the head unit 40 discharges ink while moving from the left to the right in the X-direction, thereby forming the raster lines, in the first pass. Thereafter, the head unit 40 moves by f in the Y-direction, and in the second pass, the head unit discharges ink while moving from the right to the left in the X-direction, on the contrary to the first pass, thereby completing the raster lines. In the bidirectional printing, the returning operation of the head unit 40 is not necessary, such that the head unit 40 can complete raster lines for two lines while reciprocating in the X-direction. Therefore, it is possible to reduce the time for printing even in the unidirectional printing.

In the printing method shown in FIG. 4, there are areas that are not covered between the raster lines at the back and the front in the paper width direction. Therefore, the area without gaps between the raster lines is the image width where the printer 1 can print in the Y-direction.

Further, a "pixel area" and a "line area" are set for the following description. The "pixel area" indicates a rectangular area virtually defined on the medium S and the size is determined in accordance with the print resolution. One "pixel area" on the medium S and one "pixel data" on image data correspond to each other. Further, the "line area" is an area implemented by a plurality of pixel areas arranged in the X-direction. The "line area" corresponds to "pixel line data" where a plurality of pixel data on the image data is arranged in the direction corresponding to the X-direction.

Smaller numbers are given sequentially from the line area at the back in the Y-direction. For example, in the printing method shown in FIG. 4, the raster line (dotted line) formed by the nozzle #1 in the third pass is a raster line formed in a first line area. The raster line formed in the second line area is formed by the nozzle #2 in the second pass and the raster line formed in the third line area is formed by the third nozzle #3 in the first pass. Further, the raster line formed in the seventh line area is formed by the fourth nozzle #4 in the first pass and the raster line formed in the eighth line area is formed by the second nozzle #2 in the fourth pass. Further, in the printing method of the embodiment, it is not concluded that the nozzles forming the raster lines in adjacent line areas are the same, even in the line areas formed by the same second nozzles #2.

Density Irregularity

When printing is performed by the method of Comparative Example 1 using the printer 1, the estimated landing positions of the ink dots may be deviated or the discharge amount of ink may be different in the Y direction due to variations in the machining accuracy of the nozzle lines discharging the ink or the like. As a result, density irregularity of the formed raster lines may be generated. When the "density irregularity" is generated, the printed surface is seen as if stripes are formed thereon (banding), such that the image quality of the printed image is deteriorated.

Hereinafter, "density irregularity" is described. Further, the reason for the generation of density irregularity that is generated in an image formed by unidirectional printing is described in order to simplify the description.

Figure 5A:
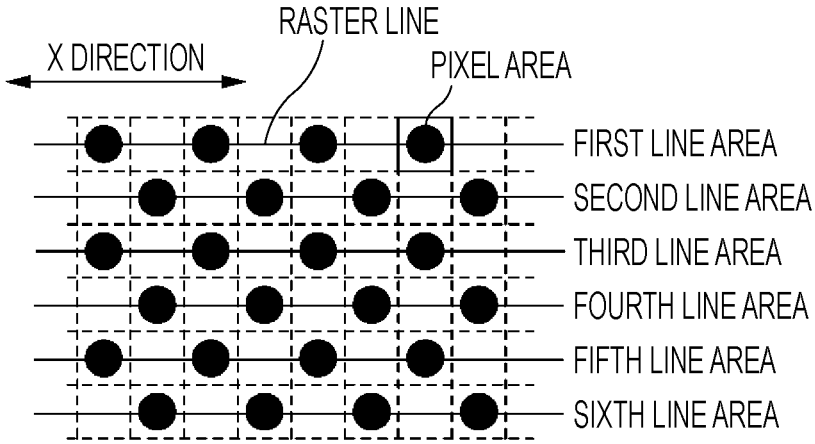
FIG. 5A is a view illustrating the shape of raster lines when dots are ideally formed.

FIG. 5A shows an illustrative view of the shape when dots are ideally formed (when density irregularity is not generated). In the figure, since the dots are ideally formed, the dots are formed accurately in pixel areas divided by dashed lines and raster lines are regularly and correctly formed along the line areas. In the line areas, pieces of an image according to coloring of the areas are formed. In the embodiment, it is assumed that an image with predetermined density where the dot creation ratio is 50% is printed.

Figure 5B:
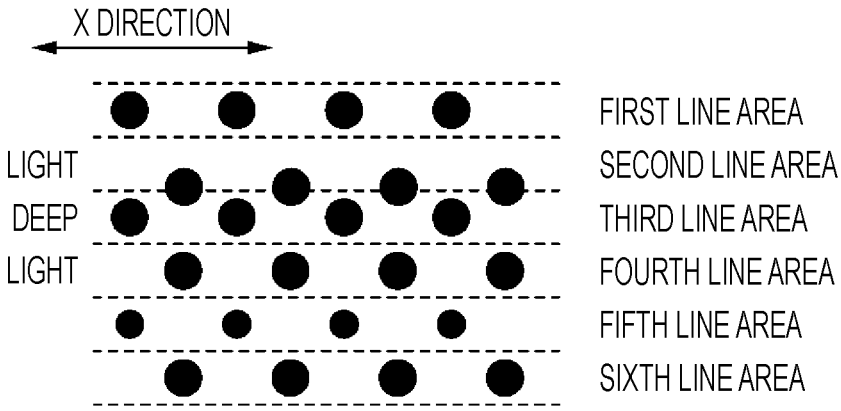
FIG. 5B is a view illustrating the shape of raster lines when density irregularity is generated.

Next, FIG. 5B shows an illustrative view of the shape when density irregularity is generated. The figure shows when the ink droplets discharged from the nozzles are deviated from the estimated landing positions by an error in position or size of the nozzle holes in manufacturing of the head 40. For example, in FIG. 5B, the raster lines formed in the second line area in FIG. 5A are relatively and collectively formed in the third line area. As a result, the density of the second line area becomes light, while the density of the third line area becomes deep. Meanwhile, the ink amount of the ink droplets discharged to the fifth line area is smaller than the regulated amount and the dots formed in the fifth line area are small. As a result, the density of the fifth line area is light.

When an image formed by line areas having different density is seen macroscopically, streaky density irregularity is seen in the direction where the raster lines are formed (X direction in the embodiment) (banding). When the density irregularity is visible, it gives a sense that the image quality is deteriorated is shown, such that it is necessary to reduce the visibility of the density irregularity.

Comparative Example 2

Comparative Example 2 is provided as a method of reducing the visibility of the influence of the density irregularity described in Comparative Example 1 as much as possible. In Comparative Example 2, one raster line is formed by a plurality of nozzles. That is, for one line, the raster line is formed by moving the head 41 several times to overlap. Accordingly, the deviation of the landing positions of the ink dots due to an error in the accuracy of the nozzle in manufacturing is averaged and the density irregularity becomes difficult to see.

Description of Printing Operation

Figure 6:
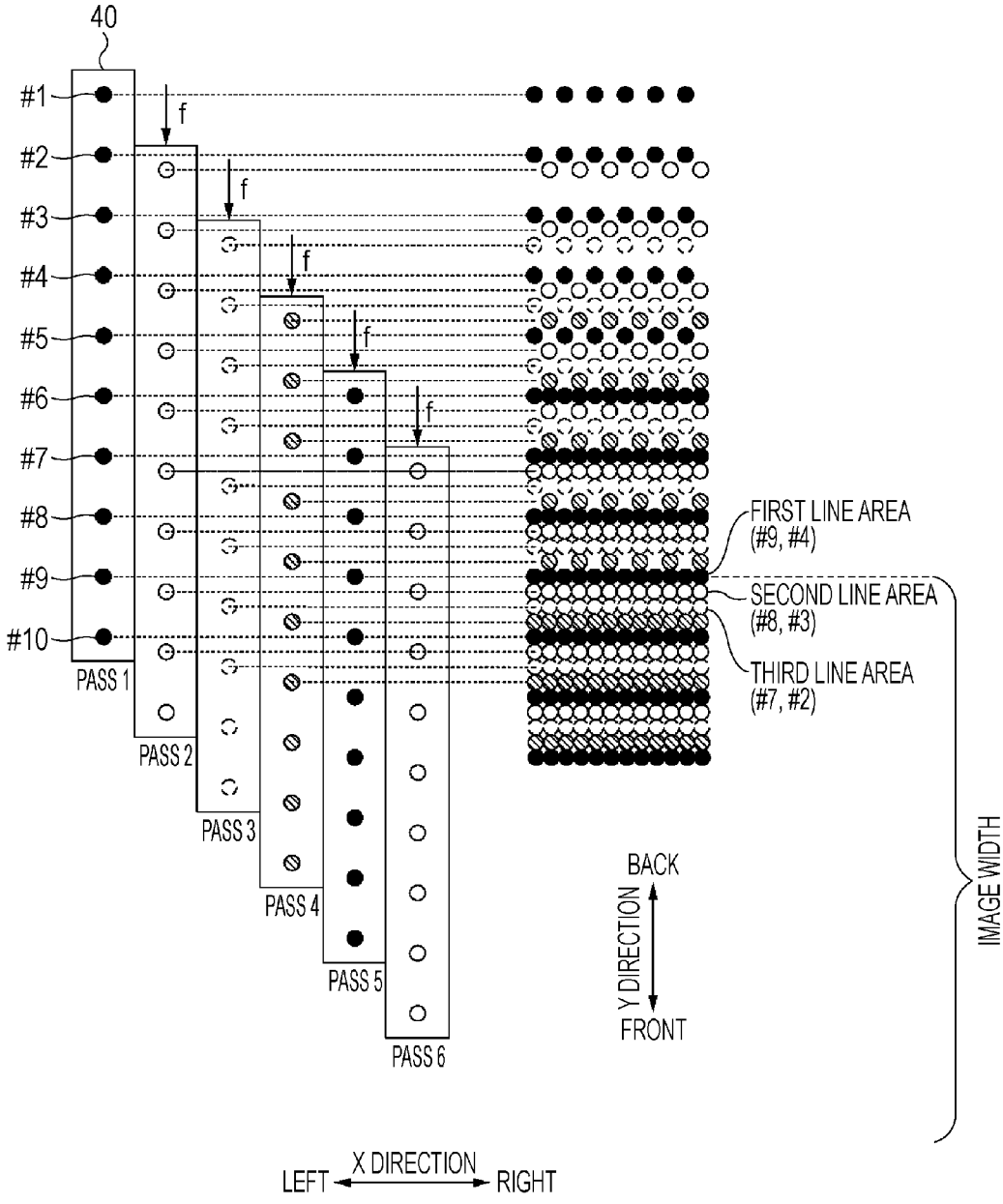
FIG. 6 is a view illustrating a printing operation performed by a printer according to Comparative Example 2.

FIG. 6 is a view illustrating a printing operation performed by the printer 1 according to Comparative Example 2. Description is provided under the assumption that the arrangement of conditions of the nozzles disposed on the head is the same as that of Comparative Example 1.

In Comparative Example 2, while the head unit 40 moves in the X direction in one pass, the nozzles intermittently form dots at an interval of several dots. Further, in another pass, dots are formed to compensate for the intermittent dots formed in advance by other nozzles (to fill the gaps between the dots), such that one raster line is formed by a plurality of nozzles. Hereafter, this printing method is referred to as overlap printing, and when one raster line is formed in M-time passes, it is defined as an "overlap number M".

In FIG. 6, the nozzles intermittently form dots at an interval of one dot, such that dots are formed in the odd-numbered pixels or the even-numbered pixels in every pass. Further, since one raster line is formed by two nozzles, the overlap number M is 2.

Further, in the overlap printing, in order to perform recording with a constant movement amount f of the head unit 40 in the Y-direction, when the number of nozzles that can discharge ink is N (integer) and the Y-directional gap of dots to form is D, (1) N/M is an integer, (2) N/M and k are in a disjoint relationship, and (3) the movement amount f is set as (N/M)·D, which are the conditions.

In FIG. 6, the nozzle group includes ten nozzles (#1 to #10) arranged in the Y-direction. When the nozzle pitch k of the nozzle group is 4, it is possible to use all the nozzles in order to satisfy the conditions for performing the overlap printing, "N/M=10/2=5 and k=4 are in a disjoint relationship". Further, since ten nozzles are used, conveying is performed at a movement amount of f=5·D. As a result, for example, it is possible to form dots at a dot gap of 720 dpi (=D) on paper, using the nozzle group having a nozzle pitch of 180 dpi (4·D).

In FIG. 6, the nozzles form dots in the odd-numbered pixels in the first pass, the nozzles form dots in the even-numbered pixels in the second pass, the nozzles form dots in the odd-numbered pixels in the third pass, and the nozzles form dots in the even-numbered pixels in the fourth pass. That is, dots are formed in the order of odd-numbered pixels, even-numbered pixels, odd-numbered pixels, and even-numbered pixels in all of the earlier four passes. Further, the dots are formed in the reverse order of the earlier four passes, in the order or even-numbered pixels, odd-numbered pixels, even-numbered pixels, and odd-numbered pixels, in the latter four passes (fifth pass to eighth pass). Further, the order of forming dots after the ninth pass is the same as the order of forming dots from the first pass.

As a result, the first line area is formed by two different nozzles, #9 of the first pass and #4 of the fifth pass. Similarly, the second line area is formed by two different nozzles, #8 of the second pass and #3 of the sixth pass.

Further, in this case, the movement directions of the head unit 40 may be the same (unidirectional printing) or may be different (bidirectional printing) in the first pass to fifth pass.

Density Irregularity

Figure 7:
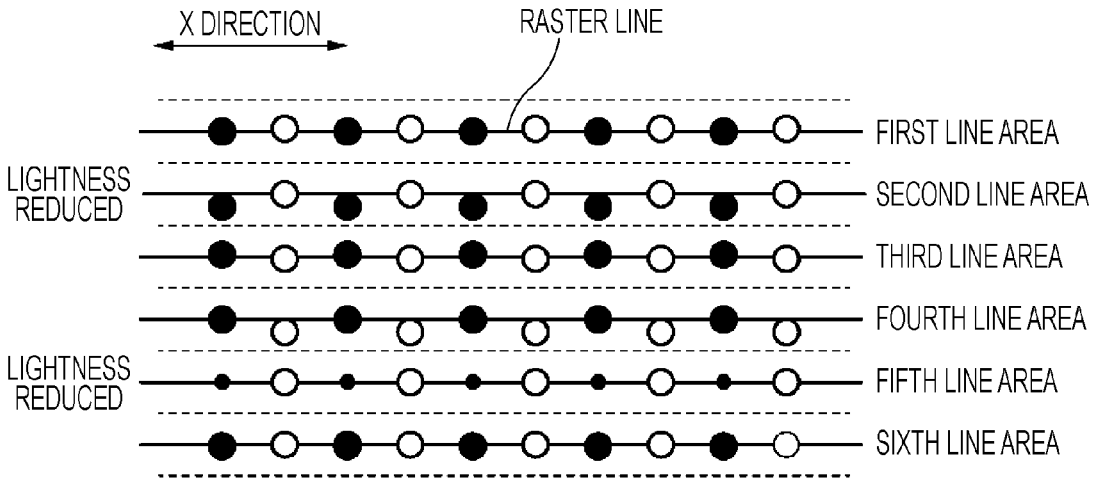
FIG. 7 is a view illustrating the shape of dot formation according to Comparative Example 2.

FIG. 7 is a view illustrating the shape of dot formation according to Comparative Example 2. The figure shows the shape when dot lines are formed by the overlap printing, by the head 40 having the same nozzle error as that shown in FIG. 5B.

In FIG. 5B, the raster line that is supposed to be formed in the second line area is collectively formed in the third line area, such that the density of the second line area becomes light and the density of the third line area becomes deep. Meanwhile, one raster line is formed by two different nozzles in Comparative Example 2. In this figure, dots (●) represented by black circles are formed by ink discharged from predetermined nozzles in the first pass and dots (○) represented by white circles are formed by ink discharged from nozzles different from the predetermined nozzles in the second pass. That is, ● and ○ are formed by different nozzles in different passes. Therefore, even if dots are formed at deviated positions by abnormal nozzles in one pass, dots are likely to be formed at appropriate positions by normal nozzles in another pass. For example, in FIG. 7, ● are formed in the second line area, deviating from the third line area, in the first pass, but ○ are likely to be formed at the right positions in the second pass, such that lightness of density of the second line area is reduced more than Comparative Example 1.

Further, in FIG. 5B, the ink amount of the ink droplets discharged to the fifth line area is smaller than the regulated amount and the density of the fifth line area becomes light. However, in FIG. 7, even if small ● are formed in the first pass in the fifth line area, ○ are likely to be formed in an appropriate size in the second pass, such that the lightness of the density of the line area is reduced more than Comparative Example 1.

As described above, the influence due to deviation of landing positions of the dots is averaged by forming dots with different nozzles for the same line areas by the overlap printing in Comparative Example 2. Therefore, the density non-uniformly is difficult to see as compared with Comparative Example 1.

However, even though the deviation of the dots is difficult to see, half of the dots in the same line area are formed at the deviated positions (for example, ● in the second line area in FIG. 7), such that the density irregularity seen in a stripe shape in the X direction is not completely removed. In particular, the density irregularity is easily recognized when printing is performed by using deep color ink.

First Embodiment

In the first embodiment, when a raster line is formed by the overlap printing, the Y-directional component is included in the movement direction of the head unit 40 at least in any one of the first pass and the second pass. That is, the dots are formed with the movement direction of the head in one pass and the movement direction of the head in the pass crossing each other (not in parallel), by inclining at least one movement direction of the head.

Printing Operation of First Embodiment

Figure 8:
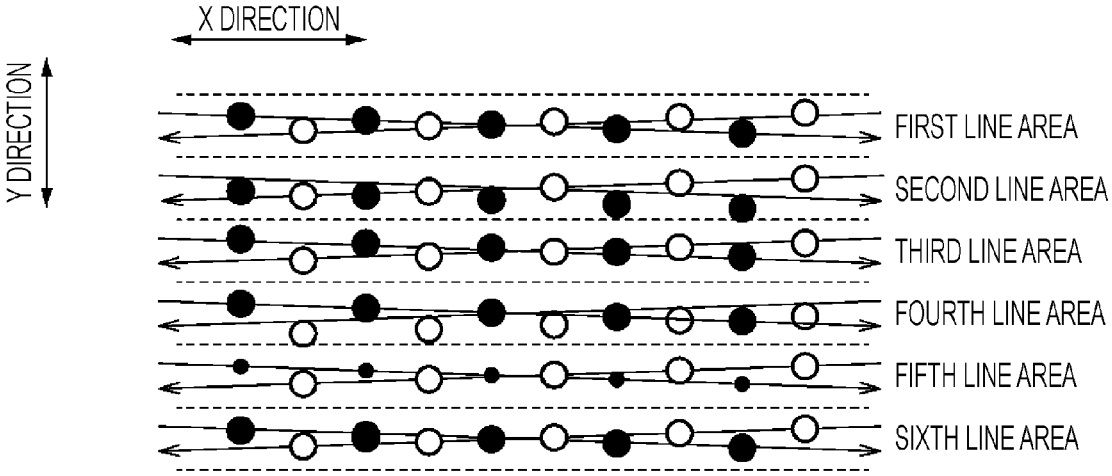
FIG. 8 is a view illustrating the shape of dot formation according to a first embodiment.

FIG. 8 is a view illustrating the shape of dot formation according to the first embodiment. The figure shows when dots (●) represented by black circles are formed in the first pass and dots (○) represented by white circles are formed in the second pass in the bidirectional printing. Further, the arrow lines indicate the movement directions of the head unit 40 in the passes. That is, the head unit 40 sequentially forms ● by intermittently discharging ink from the nozzles while moving from the left to the right in the X direction and from above to below in the Y direction in the first pass. Meanwhile, the head unit sequentially forms ○ by intermittently discharging ink from the nozzles while moving from the right to the left in the X direction and from above to the under in the Y direction in the second pass. In this process, the dots are formed such that the formation position of the ○ formed in the X direction in the second pass is positioned between the formation positions of the ● continuously formed in the X direction in the first pass. Accordingly, so-called overlap printing is performed.

In the embodiment, the Y-directional component is included in at least any one of the movement direction of the head unit 40 in the first pass and the movement direction of the head unit 40 in the second pass. Further, dot lines are formed by crossing the two movement directions. Further, in actual printing, dots may be formed by the unidirectional printing and the angle of the movement direction to the X direction (the size of the Y-directional component of the movement direction) may be changed in each pass. For example, the head may move in parallel with the X direction in the first pass and the head may move at an angle with respect to the X direction in the second pass.

Figure 9:
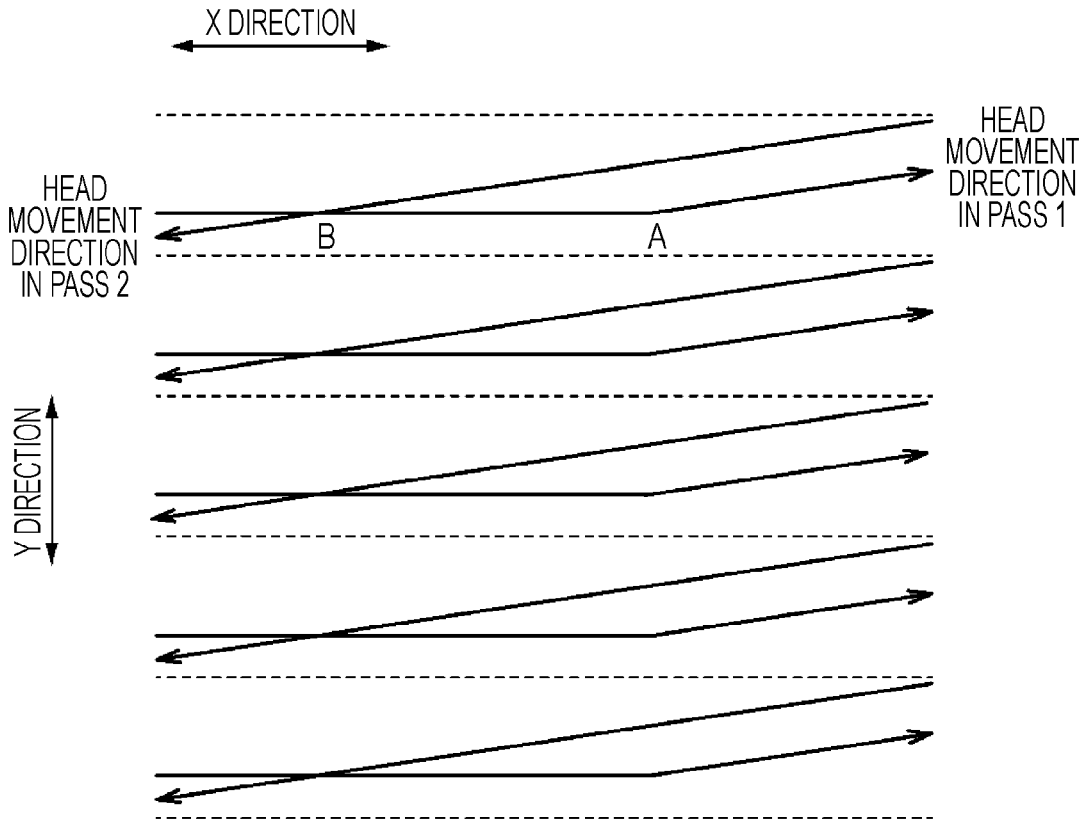
FIG. 9 is a view showing an example when the movement direction of a head changes during traveling.

Further, the movement direction of the head unit 40 may be changed in one pass. FIG. 9 shows when the movement direction is changed during traveling. The arrow lines show the movement directions of the head unit 40 in the passes. In this case, in the first pass, the head unit 40 continuously forms dots while moving in the X direction and the movement direction is changed by increasing the Y-directional component at the point A during moving. Meanwhile, in the second pass, the head unit 40 is moved at an angle from the start without changing the movement direction, such that the movement direction crosses the movement direction in the first pass at the point B in FIG. 9. The movement direction may cross the movement direction in another pass at least at a position of a portion of the movement direction (position in the X-direction), even if the movement direction of the head is changed in one pass.

Further, when the movement direction of the head and the formation position of the dots in the first pass and the movement direction of the head and the formation position of the dots in the second pass are symmetric, respectively, in the X direction or the Y-direction, it becomes simple to control the operation of the head and create the ink discharge data, such that load exerted in the controller 60 reduces and the printing can be stably performed.

As described above, in the overlap printing, as the dot lines are formed to cross each other, it is possible to reduce striped density irregularity (banding) described in Comparative Example 1 and Comparative Example 2. Hereafter, the structure is described.

Reduction of Density Irregularity

Figure 10A:
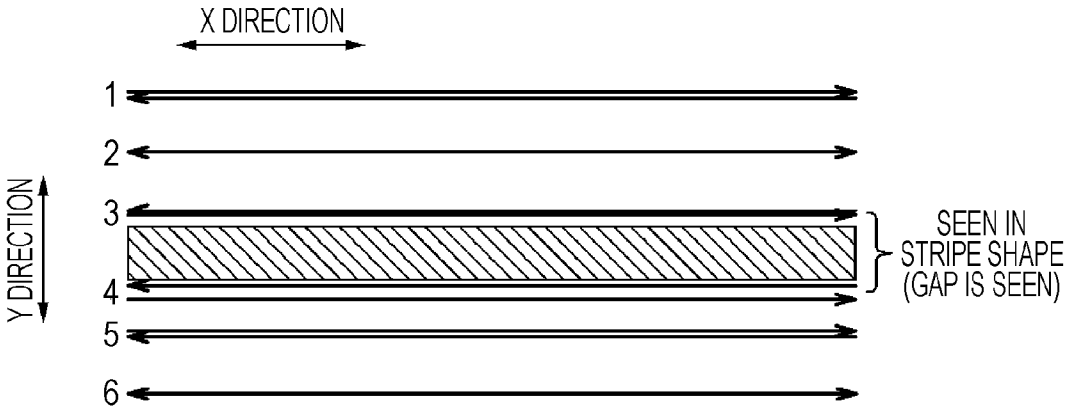
FIG. 10A is a view schematically showing the shape of generation of density irregularity in Comparative Example 1 or Comparative Example 2.
Figure 10B:
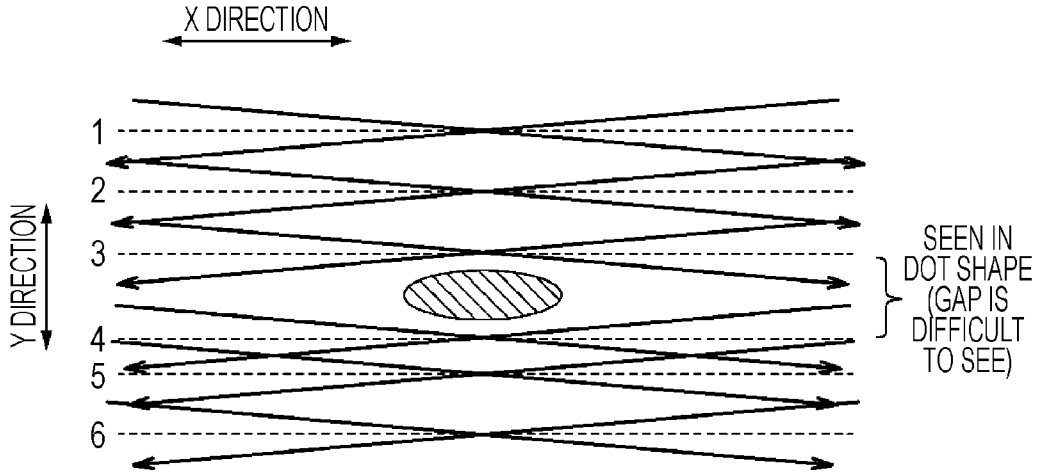
FIG. 10B is a view schematically showing the shape of generation of density irregularity in the first embodiment.

FIG. 10A schematically shows the shape of generation of density irregularity when dot lines are formed by two methods of Comparative Example 1 or Comparative Example 2. FIG. 10B schematically shows the shape of generation of density irregularity when dot lines are formed by the method of the first embodiment. In both FIGS. 10A and 10B, the arrow lines indicate dot lines formed in one pass and the numbers provided at the left of the arrow lines are the numbers of line areas that are formed.

In FIG. 10A, the movement direction in the first pass and the movement direction in the second pass are parallel and the dot lines formed in both passes are also parallel. Accordingly, in any line area, when ink is discharged, deviating from estimated landing positions of a normal state, by a manufacturing error in the nozzle positions, dots are formed at deviated positions throughout the line area in the X-direction. For example, dots are not formed in the area hatched in the figure, at the portion where the gaps between dots are open, such as the third line area and the fourth line area of FIG. 10A. Therefore, since the striped density irregularity is visible in the portion, the gap between the dots is clearly visible. Although the gaps between the dot lines are difficult to see in Comparative Example 2 in comparison to Comparative Example 1, the striped density irregularity may be seen in accordance with the combination of the nozzles used to form the dot lines.

Meanwhile, in FIG. 10B, the movement direction in the first pass and the movement direction in the second pass are not parallel, such that the dot lines are formed to cross each other at an angle, as shown in the figure. Therefore, even though the gaps are open between the dot lines, dots are not formed to deviate in the X-direction, such that dots are necessarily formed in some portions in the line areas in the X-direction. For example, although the gaps between the dots (gap in the Y-direction) are open in the third line area and the fourth line area in FIG. 10B, the area where dots are not actually formed is limited to an elliptical narrow area hatched in the figure (dot shape in actual printing). That is, since the density irregularity is seen not in a stripe shape, but a dot shape, the gaps between the dot lines are difficult to see and deterioration of the image is also difficult to see.

The printer 1 has a first mode that is suitable for forming a line image that is an image mainly implemented by lines and a second mode that is suitable for forming a natural image that is a photograph image taking a scenery of the nature. A user can select a desired mode from image forming modes in accordance with the object or usage of printing, through a user interface (not shown) when printing. Further, the methods of image process in which the printer driver creates print data from image data are different in the first mode and the second mode.

When a line image is printed, since dots arranged in lines are mainly formed, there are a lot of empty pixels in the portion except for the dot lines, such that amount of information of the image data is not much. Therefore, even if the density irregularity generated in a stripe shape is seen in a dot shape, it is difficult to see the difference and the effect of improving the image quality is limited. Meanwhile, when a natural image is printed, dots having different gradation values (dot diameters) are adjacent to each other and an image is implemented, such that the amount of information of the image data increases. Further, the edge portion is less and a large amount of noise is originally included in the natural image, such that the density irregularity is difficult to see even if it is generated in a dot shape. Therefore, when the density irregularity generated in a stripe shape can be seen in a dot shape in the natural image, the image quality is considerably improved and the effect of the embodiment is remarkably achieved.

The controller 60 performs setting such that dot lines are automatically formed by the printing method of the first embodiment when the second mode is selected in printing. Therefore, it is possible to form an image having low density irregularity and a high quality when printing the natural image.

In the bidirectional printing, as the cross angle of the dot lines formed in the first pass and the dot lines formed in the second pass is small (as the cross angle is large in the unidirectional printing), it is possible to narrow the area hatched in FIG. 10B. Accordingly, since it is possible to reduce the dot-shaped density irregularity, the density irregularity becomes more difficult to see.

Data for Discharging Ink

When an image is printed by the printer 1, data representing the positions (pixels) where ink is discharged from the nozzle disposed on the head 41 is created and the ink is discharged on the basis of the data. In the embodiment, data for printing is created by the CPU 62 from the image data of the printing target, and stored in the memory 63.

Figure 11A:
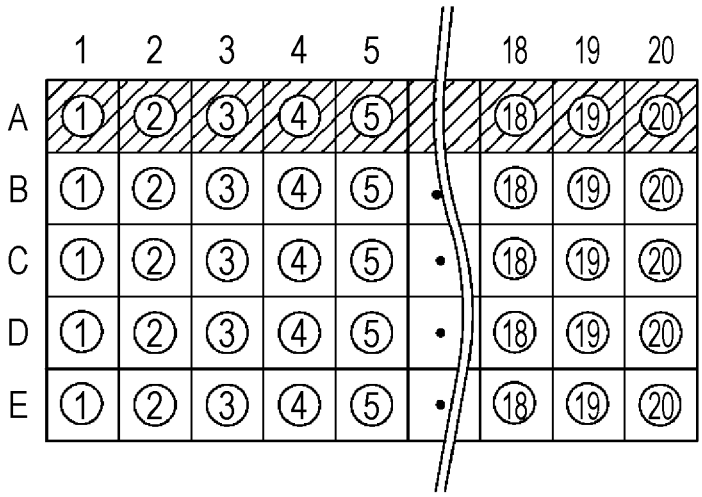
FIG. 11A is a view showing an example of ink discharge data that is used in the first embodiment.
Figure 11B:
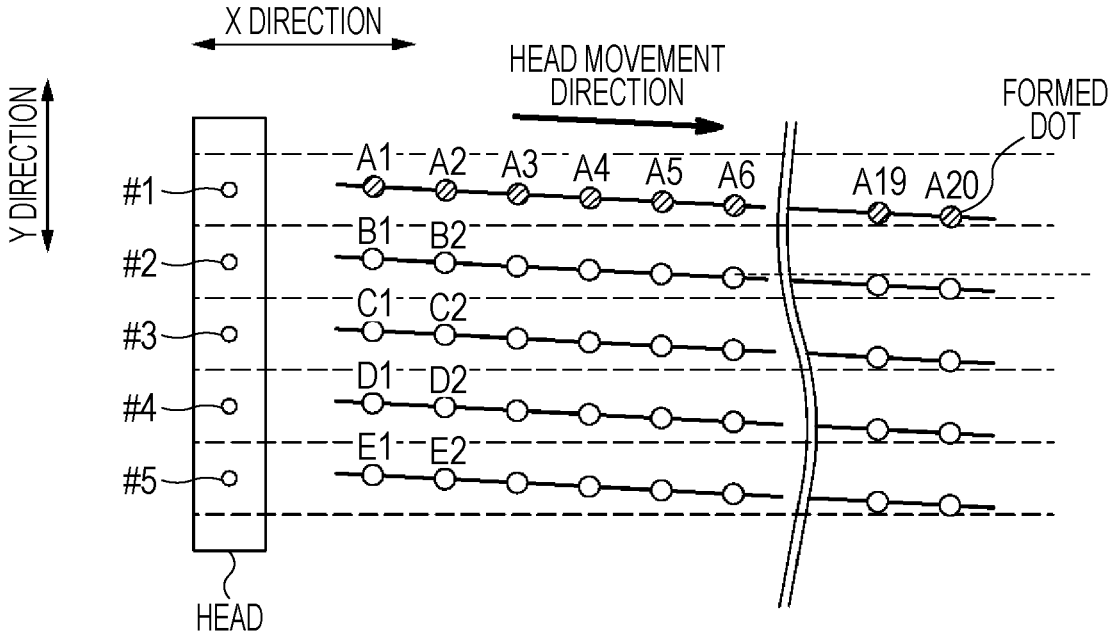
FIG. 11B is a view showing the shape of dots formed by a head on the basis of the data of FIG. 11A.

FIG. 11A shows an example of data that is used in the embodiment. FIG. 11B shows the shape of a dot formed by a head 41 on the basis on the data of FIG. 11A. For brief description, it is described when printing is performed with only one-color ink (for example, black ink), using a nozzle line composed of five nozzles indicated by #1 to #5 in one pass. Further, in FIG. 11A, twenty items of data are stored in each of the five lines of A to E corresponding to the five nozzles. For example, since ink is discharged from the nozzle #1 to the line A hatched in the figure, twenty items of data of A1 to A20 are arranged. Further, the circled numbers show the order of ink dots discharged from the nozzle in the line. That is, the ink is discharged on the basis of the data stored in the first line A1 in the nozzle #1 (line A) and the ink is discharged on the basis of the data stored in the second line A2. Since the data is used, the nozzles form dot lines composed of twenty dots in the movement direction of the head 41 by sequentially discharging liquid in one pass.

In printing, first, position data A1 is assigned to the nozzle #1, as data for discharging the ink to the first line. Similarly, position data B1, position data C1, position data D1, and position data E1 are assigned to the nozzle #2, the nozzle #3, the nozzle #4, and the nozzle #5, respectively. The nozzles #1 to #5 form dots at the designated positions (pixels) by discharging the ink in accordance with the assigned position data.

Next, position data A2 is assigned to the nozzle #1 as data for discharging the ink to the second line and position data B2 to E2 are similarly assigned to the nozzles #2 to #5. Further, when the head 41 moves by a predetermined amount in the movement direction, the ink is discharged from the nozzles #1 to #5 in accordance with the data A2 to E2.

A dot line composed of twenty dots is formed by substantially repeating the operation. In the embodiment, since the head moves at an angle, the inclined dot line composed of the dots shown in the hatched portion in FIG. 11B is formed by the nozzle #1 in accordance with the data A1 to A20 shown in the hatched portion in FIG. 11A. Similarly, a dot line where twenty dots are arranged at an angle is also formed by the nozzles #2 to #5.

It is also possible to form dot lines at an angle in the second pass.

Effect of First Embodiment

In the first embodiment, the head is moved in which the movement direction of at least one of the movement direction of the head in the first pass and the movement direction of the head in the second pass include the Y-directional component, in the overlap printing. Further, a dot line is formed while the movement directions of the head in both passes cross each other at least at a portion in the X-direction.

In a printer of the related art, when the movement directions of the head in the first pass and the second pass are parallel, striped density irregularity is generated in the movement direction, such that the image quality of the printed image may be deteriorated. However, in the embodiment since the movement directions of the head cross each other, striped density irregularity is not generated, but dot-shaped density irregularity is generated even if the density irregularity is generated. Therefore, the influence of the density irregularity on the entire image is small and it is possible to reduce the visibility of the density irregularity.

Second Embodiment

In the second embodiment, the data used for forming a dot line in one pass is different from the first embodiment.

In the first embodiment, ink dots discharged from a nozzle are formed in the same line area through one pass. For example, as illustrated in FIGS. 11A and 11B, although the nozzle #1 forms a dot line composed of twenty dots while moving at an angle in one pass, the twenty dots are all formed in the same line area (line A in FIGS. 11A and 11B). As described above, in order to make the density irregularity more difficult to see in the bidirectional printing, it is preferable to reduce the angle made by the dot line formed by the first pass and the dot line formed by the second pass as small as possible. That is, it is preferable to increase the angle of the dot line with respect to the X direction as large as possible. However, when the dot line is formed at a large angle with respect to the X-direction, that is, when the angle between the movement direction of the nozzle and the X direction is made larger, it does not correspond to the data shown in the example of FIG. 11A.

In the second embodiment, the ink dots formed by a nozzle (for example, the nozzle #1) in one pass are further formed a plurality of other different line areas. Further, the function or configuration of the printing apparatus itself is the same as those of the first embodiment.

Data for Discharging Ink

Figure 12A:
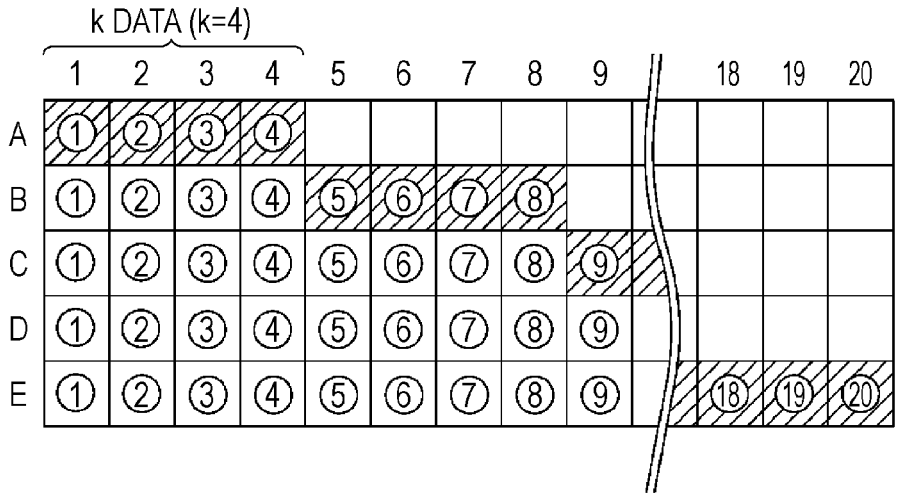
FIG. 12A is a view showing an example of ink discharge data that is used in the second embodiment.
Figure 12B:
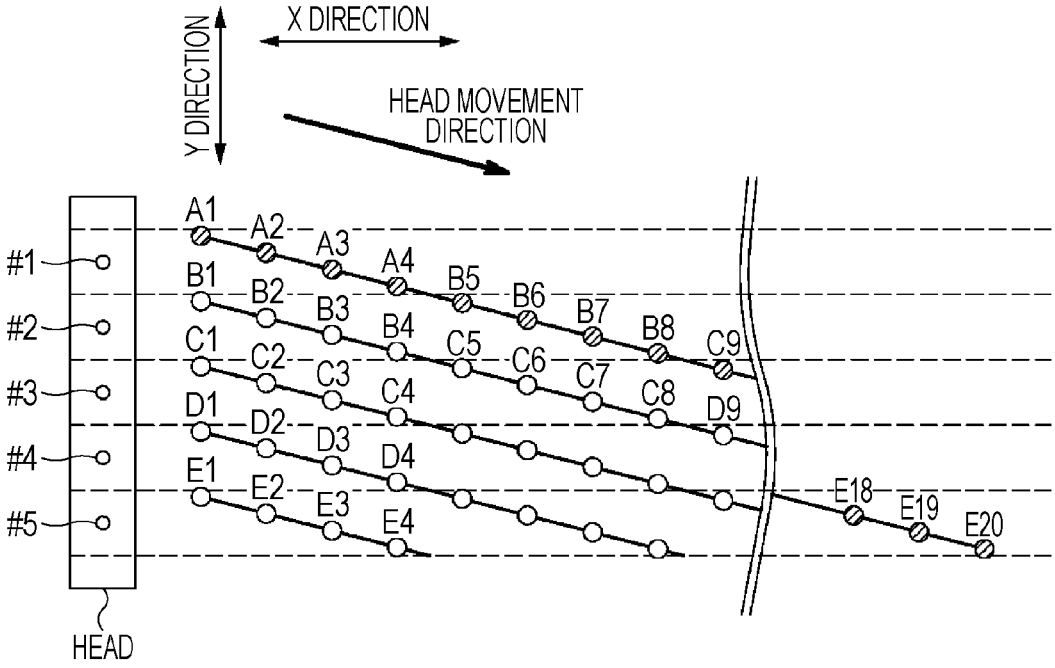
FIG. 12B is a view showing the shape of dots formed by the head on the basis of the data of FIG. 12A.

FIG. 12A shows an example of data that is used in a second embodiment. FIG. 12B illustrates when dots are formed by a nozzle line composed of five nozzles #1 to #5, similar to that illustrated in FIGS. 11A and 11B showing the shape of dots formed by the head 41, on the basis of data shown in FIG. 12A.

Further, the circled numbers show the order of ink dots discharged from the nozzle in the line in FIG. 12A. For example, in line area A, the data stored in A1 is used first by the first nozzle #1 and the data stored in A2 is used secondarily by the nozzle #1. As shown in FIG. 12B, when the inclination of the movement direction of the head with respect to the X direction is large, the nozzle #1 forms k ink dots (four dots for A1 to A2 in FIG. 12B) in the line area A while moving in the X-direction, and then moves to the line area B outside the line area A and similarly forms k ink dots (four dots for B5 to B8 in FIG. 12B). Further, it moves to the line area C, the line area D, and the line area E and forms k dots in the line areas. Accordingly, the data shown in the hatched portion in FIG. 11A is used to discharge ink from the nozzle #1. In detail, data for discharging four ink dots (A1 to A4) to the line A and four ink dots (B5 to B8) to the line B, and similarly, four ink dots (C9 to C12) to the line C, four ink dots (D13 to D16) to the line D, four ink dots (E17 to E20) to the line E is used.

Figure 13A:
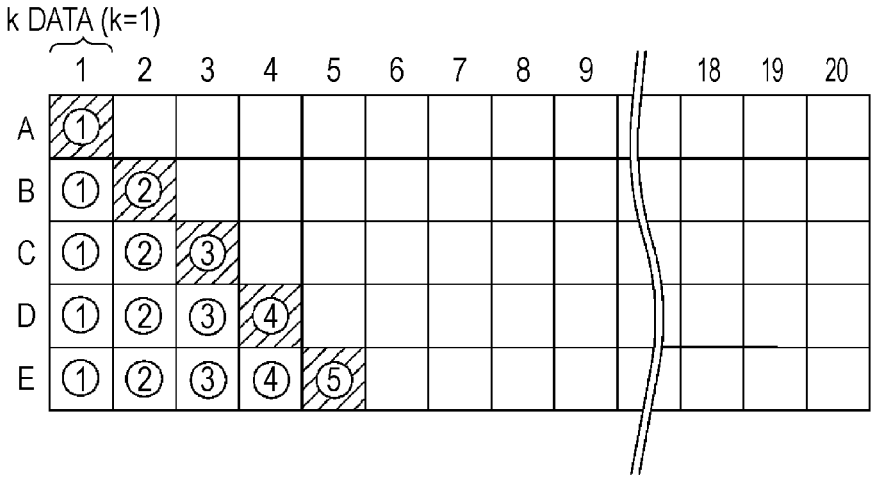
FIG. 13A is a view showing an example of ink discharge data that is used in the second embodiment when k is 1.
Figure 13B:
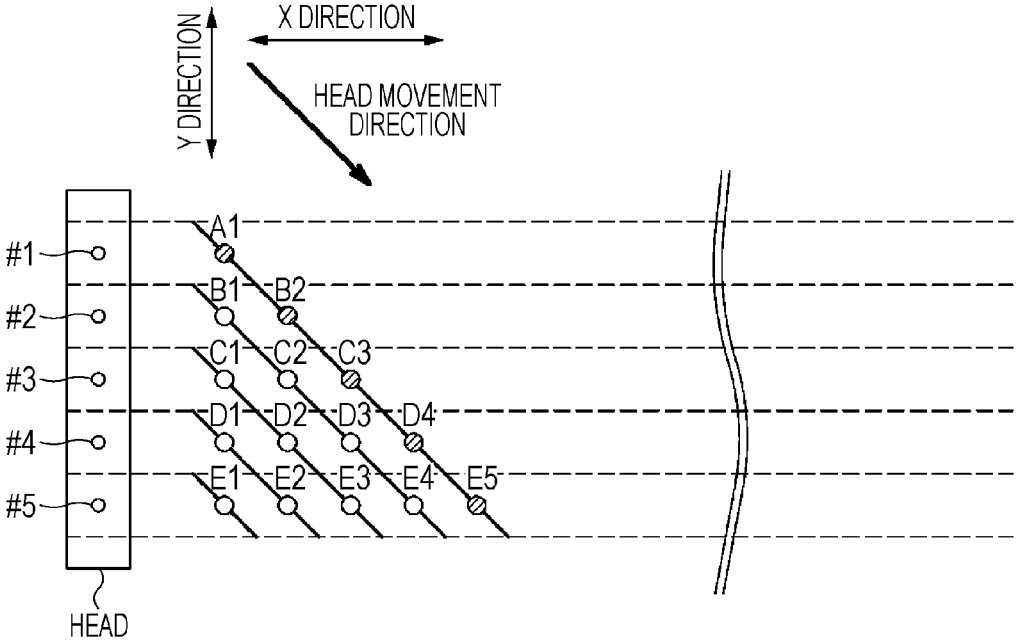
FIG. 13B is a view showing the shape of dots formed by the head on the basis of the data of FIG. 13A.

As described above, since a nozzle uses data for different line areas in one pass, it is possible to form a dot line having inclination (angle made with the X-direction) larger than the first embodiment. Further, it is possible to form a dot line having a large angle, as the value of "k" which is the number of dots formed in one line area by a nozzle is smaller. FIG. 13A shows an example of data when k is 1 in the second embodiment. FIG. 13B shows the shape of a dot formed by a head 41 on the basis on the data of FIG. 13A. When k is 1, one dot is formed in each of the line areas A to E. For example, as shown in the hatched portions in FIGS. 13A and 13B, the nozzle #1 forms a dot at the position A1 in the line area A and forms a dot at the position B2 in the line area B while the head moves in the X-direction. Similarly, one dot is formed at the positions C3, D4, and E5, respectively, by the nozzle #1. Further, as shown in FIG. 13B, it is possible to form a dot line having an abnormally large angle (rapid incline) made with the X-direction.

On the other hand, as shown in FIG. 13B, when a dot line having a large angle (rapid inclination) made with the X direction is formed, the image width in the X direction is reduced as much as the rapid inclination. For example, in FIG. 11B, although the nozzle #1 forms twenty dots A1 to A20 in one pass, in FIG. 13B, the nozzle #1 forms only five dots A1 to E5 in one pass. In this process, an appropriate image width is ensured by operating the head as follows.

Figure 14:
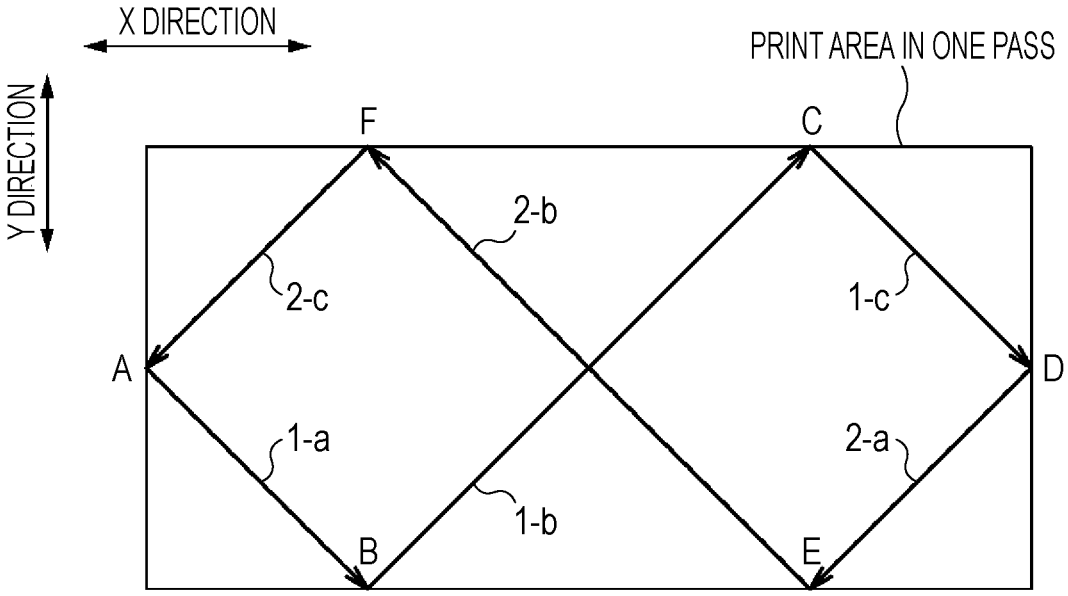
FIG. 14 is a view showing a modified example of a moving operation of a head according to the second embodiment.

FIG. 14 shows a modified example of the moving operation of the head. In the first pass, the head starts to move from the point A at the center portion of the left in the X direction and moves down in the Y direction while moving to the right in the X-direction. That is, the head discharges ink from the nozzle line while moving down at an angle from the point A (in the head movement direction 1-*a* in FIG. 14) and forms a plurality of dot lines in parallel with 1-*a*. When the head reaches the point B that is the lower end position in the Y direction of the printing area in the first pass, the movement direction is changed to 1-*b* in FIG. 14, and the head forms a dot line in 1-*b* while moving to the point C that is the upper end position in the Y direction in the printing area. Further, when the head reaches the point C, the movement direction is changed to 1-*c*, and the head forms a dot line in 1-*c* while moving to the point D that is the right end position in the X-direction. Further, in the second pass, the head starts from the point D and forms dot lines in 2-*a*, 2-*b*, and 2-*c* while returning to the point A through the points E and F.

Although the bidirectional printing is illustrated in FIG. 14, as the unidirectional printing, a method of moving the head sequentially to the points A, F, E, and D in the second pass may be possible. Further, in FIG. 14, although the movement direction in the first pass and the movement direction in the second pass are symmetric with respect to the X-direction, it is not always necessary to symmetrically move the head.

Effect of Second Embodiment

In the second embodiment, the dot line formed by a nozzle (for example, the nozzle #1) in one pass is further formed a plurality of other different line areas. Therefore, it is possible to form a dot line having a large Y-directional component, that is, a dot line having large inclination with respect to the X-direction.

It is possible to achieve a large difference in inclination by providing the dot line formed in the first pass and the dot line formed in the second pass with large inclination and forming them to cross each other. The dot-shaped area shown as density irregularity correspondingly narrows, such that it is possible to reduce the visibility of the density irregularity.

Other Embodiments

Although a printer or the like is described as an embodiment, the embodiment is provided to facilitate understanding of the invention and should not be construed as limiting the invention. The invention may be changed and modified without departing from the spirit and the equivalents are included in the invention. In particular, the embodiments described below are included in the invention.

Ink Used Herein

In the embodiments described above, although an example of printing an image by using four color inks of CMYK has been described, it is not limited thereto. For example, recording may be performed by ink of colors other than CMYK, such as light cyan, light magenta, white, and clear.

Arrangement of Nozzle Line

Although the nozzle lines of the nozzle unit are sequentially arranged in the order of KCMY in the conveying direction, it is not limited thereto. For example, the order of the nozzle lines may be changed and the number of nozzle lines of K ink may be larger than the numbers of nozzle lines of other ink.

Printer Driver

The process of the printer driver may be performed in the printer. In this case, the printing apparatus is composed of the printer and a PC where the driver is installed.

What is claimed is:

1. A liquid discharge apparatus comprising:

a movable head having a nozzle line with nozzles arranged in a predetermined direction; and a control unit which controls the movable head so as to cause the movable head to be moved in the predetermined direction and a direction perpendicular to the predetermined direction and which causes the movable head to perform a first liquid discharge process and a second liquid discharge process, which both sequentially form dots on a medium by intermittently discharging liquid from the nozzles while moving the head, the second liquid discharge process discharging liquid from the nozzles so that the dots formed during the second liquid discharge process are positioned between dot formation positions of the dots formed in the first liquid discharge process in the direction perpendicular to the predetermined direction, wherein the control unit moves the moveable head in both the predetermined direction and a direction perpendicular to the predetermined direction during of one of the first liquid discharge process and the second liquid discharge process such that a line of sequential dots formed on the medium during the one of the first liquid discharge process and the second liquid process are not parallel to a line of sequential dots formed during the other of the first liquid discharge process or the second liquid discharge process, wherein the control unit moves the moveable head such that a moving direction in which the moveable head is moved during the first liquid discharge process is symmetric with respect to the perpendicular direction or the predetermined direction to a moving direction in which the moveable head is moved during the second liquid discharge process.

2. The liquid discharge apparatus according to claim 1, wherein the control unit moves the moveable head moves the movable head in a forward moving direction in the predetermined direction during the first liquid discharge process and in a reverse moving direction in the predetermined during the second liquid discharge process.

3. The liquid discharge apparatus according to claim 1, wherein a first mode that is suitable for forming an image mainly implemented by lines and a second mode that is suitable for forming an image of a photograph are selectable and when the second mode is selected, the control unit moves the moveable head such that a line of sequential dots formed on the medium during the one of the first liquid discharge process and the second liquid process are not parallel to a line of sequential dots formed during the other of the first liquid discharge process or the second liquid discharge process.

4. A liquid discharge method comprising:

moving a moveable head having a nozzle line with nozzles arranged in a predetermined direction; and controlling the movable head using a control unit so as to cause the movable head to be moved in the predetermined direction and a direction perpendicular to the predetermined direction and which causes the movable head to perform a first liquid discharge process and a second liquid discharge process, which both sequentially form dots on a medium by intermittently discharging liquid from the nozzles while moving the head, the second liquid discharge process discharging liquid from the nozzles so that the dots formed during the second liquid discharge process are positioned between dot formation positions of the dots formed in the first liquid discharge process in the direction perpendicular to the predetermined direction, wherein the control unit moves the moveable head in both the predetermined direction and a direction perpendicular to the predetermined direction during of one of the first liquid discharge process and the second liquid discharge process such that a line of sequential dots formed on the medium during the one of the first liquid discharge process and the second liquid process are not parallel to a line of sequential dots formed during the other of the first liquid discharge process or the second liquid discharge process, wherein the control unit moves the moveable head such that a moving direction in which the moveable head is moved during the first liquid discharge process is symmetric with respect to the perpendicular direction or the predetermined direction to a moving direction in which the moveable head is moved during the second liquid discharge process.

* * * * *